US006380663B1

(12) United States Patent
Ikedo et al.

(10) Patent No.: US 6,380,663 B1
(45) Date of Patent: Apr. 30, 2002

(54) GAS DISCHARGE TUBE HAVING A SIDE TUBE WITH GLASS COATING

(75) Inventors: Tomoyuki Ikedo; Kouzou Adachi; Yoshinobu Ito; Ryotaro Matui, all of Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 6 days.

(21) Appl. No.: 09/602,899

(22) Filed: Jun. 23, 2000

Related U.S. Application Data

(63) Continuation-in-part of application No. PCT/JP98/05821, filed on Dec. 22, 1998.

(30) Foreign Application Priority Data

Dec. 24, 1997 (JP) ..... 9-355352
Sep. 7, 1998 (JP) ..... 10-252590
Sep. 7, 1998 (JP) ..... 10-252603

(51) Int. Cl.[7] ..... H01J 1/02

(52) U.S. Cl. ..... 313/25; 313/600; 313/281; 313/313; 313/493; 313/634

(58) Field of Search ..... 313/493, 25, 634, 313/117, 112, 613, 243, 292, 581, 589, 590, 622, 614, 313, 600

(56) References Cited

U.S. PATENT DOCUMENTS 3,758,802 A * 9/1973 Kubo et al. ..... 313/479
4,020,379 A * 4/1977 Manning ..... 313/113

FOREIGN PATENT DOCUMENTS

| | | |
|---|---|---|
| JP | 7-326324 | 12/1995 |
| JP | 8-77965 | 3/1996 |
| JP | 8-77969 | 3/1996 |
| JP | 8-77979 | 3/1996 |
| JP | 8-222185 | 8/1996 |
| JP | 8-222186 | 8/1996 |
| JP | 8-236081 | 9/1996 |
| JP | 10-302729 | 11/1998 |
| JP | 10-302730 | 11/1998 |
| JP | 10-302731 | 11/1998 |

* cited by examiner

*Primary Examiner*—Michael H. Day
*Assistant Examiner*—Joseph Williams
(74) *Attorney, Agent, or Firm*—Morgan, Lewis & Bockius LLP

(57) ABSTRACT

In a gas discharge tube in accordance with the present invention, one or both of the inner wall face and outer wall face of a side tube body are provided with a coating made of a glass material or ceramics. As a result, the side tube body can be made of various materials regardless of properties of the gas filling the inside, whereby the gas discharge tube can have a wider range of processed forms and smaller dimensions at the same time, and its mass production can freely be carried out.

2 Claims, 2 Drawing Sheets

GAS DISCHARGE TUBE HAVING A SIDE TUBE WITH GLASS COATING

RELATED APPLICATION

This is a Continuation-In-Part application of International Patent Application Ser. No. PCT/JP98/05821 filed on Dec. 22, 1998, now pending.

BACKGROUND OF THE INVENTION

1. Field of the Invention

The present invention relates to a gas discharge tube; and, in particular, to a gas discharge tube for use as a light source for a spectroscope, chromatography, or the like.

2. Related Background Art

As techniques in such a field, those disclosed in Japanese Patent Application Laid-Open Nos. HEI 7-326324 and HEI 8-222185 have conventionally been known. In the gas discharge tubes described in these publications, a sealed envelope is constituted by a side tube made of glass and a stem made of glass, stem pins are secured to the stem, anode and cathode sections are secured to the respective stempins, and the sealed envelope is filled with about several Torr of deuterium gas. Such a gas discharge tube is constructed as a deuterium lamp and is utilized as a stable UV light source.

SUMMARY OF THE INVENTION

Since the conventional gas discharge tubes are configured as mentioned above, however, there have been problems as follows.

Namely, while the above-mentioned sealed envelope is made of glass as a whole from the viewpoint of freedom in processing, the junction temperature between the side tube made of glass and the stem made of glass exceeds 1000° C. when they are thermally fused to each other. As its countermeasures, it is necessary to employ a floating structure in which the anode and cathode sections are spaced from the junction, whereby the sealed envelope increases its dimensions, which inevitably enlarges the gas discharge tube itself.

In order to overcome the problems mentioned above, it is an object of the present invention to provide a gas discharge tube which attains smaller dimensions and freedom in processing at the same time.

For making the gas discharge tube smaller, the inventors have tried experiments using various materials for the stem and side tube. As a result, it has been found that, in the case where the side tube itself is made of a material such as a Kovar metal or the like while a material coated with a glass material or ceramics is used for its wall face, the temperature of the anode and cathode sections rises only about several tens of degrees at the time of joining the sealed envelope thereto, whereby there are no thermal damages to the anode and cathode sections even in a structure in which the side tube is made so small that the cathode and anode sections are disposed closer to the side tube body.

The present invention is achieved according to this finding. Namely, in order to overcome the above-mentioned problems, the gas discharge tube of the present invention is a gas discharge tube having a sealed envelope at least a part of which transmits light, the sealed envelope being filled with a gas and being provided with anode and cathode sections disposed therein, electric discharge being generated between the anode and cathode sections, so that the light-transmitting part of the sealed envelope emits predetermined light outside. The sealed envelope comprises a stem for securing the anode and cathode sections by way of respective stem pins independent from each other a side tube surrounding the anode and cathode sections and being secured to the stem, and a light projection window secured to the side tube and formed from a material transmitting light, wherein the side tube has a wall face coated with a glass material or ceramics.

According to the present invention, the side tube of the gas discharge tube can be formed from a material (e.g., cover metal) other than glass, and there are no thermal damages to the anode and cathode sections at the time of joining the side tube and the stem to each other even in a structure in which the side tube is made so small that the cathode and anode sections are disposed closer to each other, whereby smaller dimensions are easily obtained. Further, since a metal or the like is used as a side tube material, the freedom and stability of processing enhance. Since the tube wall face is coated with a glass material or ceramics, materials which may react with or occlude gases filling the envelope can also be used as a tube material without generating such a reaction or occlusion, whereby it is favorable in that the tube material has a wider selection, lowers the cost, and enhances the easiness in processing.

Preferably, the coating of the wall face of the side tube is crystallized glass. The crystallized glass is glass in which crystals are deposited, so that the crystals and glass are in a mixed state, whereby it is quite favorable as the coating for the side tube.

The present invention will become more fully understood from the detailed description given hereinbelow and the accompanying drawings. They are given by way of illustration only, and thus should not be considered limitative of the present invention.

Further scope of applicability of the present invention will become apparent from the detailed description given hereinafter. However, it is clear that the detailed description and specific examples, while indicating preferred embodiments of the invention, are given by way of illustration only, and various changes and modifications within the spirit and scope of the invention will become apparent to those skilled in the art from this detailed description.

BRIEF DESCRIPTION OF DRAWINGS

FIG. 1 is a sectional view showing an embodiment of the gas discharge tube in accordance with the present invention, whereas

DETAILED DESCRIPTION OF PREFERRED EMBODIMENTS

Figure 1:
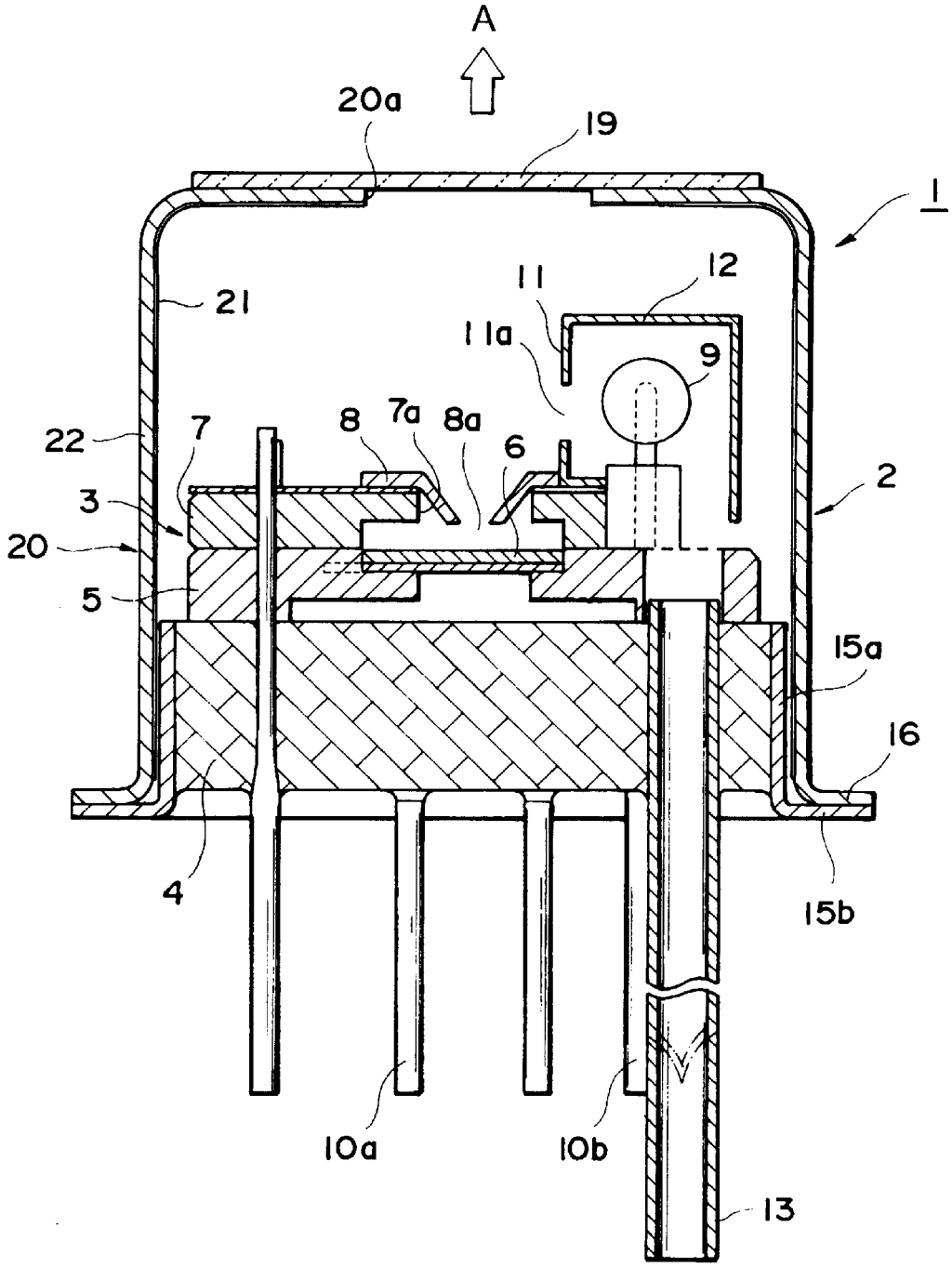

In the following, preferred embodiments of the gas discharge tube in accordance with the present invention will be explained in detail with reference to the accompanying drawings. To facilitate the comprehension of the explanation, the same reference numerals denote the same parts, where possible, throughout the drawings, and a repeated explanation will be omitted.

FIG. 1 is a sectional view showing a gas discharge tube in accordance with the present invention. The gas discharge tube 1 shown in this drawing is a head-on type deuterium lamp and has a sealed envelope 2 filled with about several Torr of deuterium gas, whereas a light-emitting part assembly 3 is contained in the sealed envelope 2. The light-emitting part assembly 3 has an anode support plate 5 which is made of ceramics and disposed on a stem 4. An anode plate 6 is disposed on the anode support plate 5, so as to be spaced from the stem 4. The anode plate 6 is welded and secured to the upper end of a stem pin 10*a* which is fixed so as to penetrate through the stem 4. A spacer 7 made of ceramics is disposed on the anode support plate 5, a focusing electrode plate 8 is disposed on the spacer 7, and a focusing opening 8*a* formed in the focusing electrode plate 8 is disposed so as to face into an opening 7*a* of the spacer 7, thereby making the focusing electrode plate 8 opposed to the anode plate 6.

Beside the focusing opening 8*a,* a cathode section 9 is disposed on the upper side from the spacer 7. The cathode section 9 is welded and secured to the upper end of a stem pin 10*b* fixed so as to penetrate through the stem 4, and generates thermions as a voltage is applied thereto. Between the cathode section 9 and the focusing opening 8*a,* a discharge rectifying plate 11 is disposed at a position deviated from an optical path (in the direction directly upward from the focusing opening 8*a* in the drawing, i.e., the direction of arrow A). The discharge rectifying plate 11 is provided with an electron releasing window 11*a* formed as a rectangular opening for transmitting therethrough thermions generated in the cathode section 9. Also, the discharge rectifying plate 11 is welded and secured to the upper face of the focusing electrode plate 8, and is provided with a cover plate 12 having an L-shaped cross section so as to surround the upper side of the cathode section 9 and the rear side thereof opposite from the electron releasing window 11*a*. The cover plate 12 keeps the sputtering materials or evaporated materials released from the cathode section 9 from attaching to a light projection window 19 made of silica glass or UV-transmitting glass.

While thus configured light-emitting part assembly 3 is disposed within the sealed envelope 2, an exhaust pipe 13 is secured to the stem 4 since it is necessary for the sealed envelope 2 to be filled with several Torr of deuterium gas. Utilizing this exhaust pipe 13, the sealed envelope 2 can be appropriately filled with a predetermined pressure of deuterium gas after the air is once evacuated therefrom. After the filling, the exhaust pipe 13 is closed, whereby the sealed envelope 2 is sealed off.

Here, the sealed envelope 2 has a side tube 20 made of a metal such as a Kovar metal, stainless steel, or the like, which is formed like a cylinder whose both sides are open, whereas the glass-made projection window 19 is secured to an outer wall face 22*b* of a side tube body 22 so as to close a circular opening portion 20*a* formed at the top part of the side tube 20. The stem 4 is formed like a cylindrical column from glass (e.g., Kovar glass), whereas its peripheral part is provided with a joint member 15 made of a metal (e.g., Kovar metal). The joint member 15 comprises a cylindrical body portion 15*a,* and a first flange portion 15*b* radially extending like a brim from the lower end of the body portion 15*a*. The body portion 15*a* of the joint member 15 is secured to the outer wall face of the stem 4 by fusion or bonding.

On the other hand, the other open end side of the side tube 22 is provided with a second flange portion 16, made by integral. molding of the side tube 20, radially extending like a brim from the lower end thereof. Hence, while the stem 4 is being inserted into the side tube 20 in a state where the light-emitting part assembly 3 is secured onto the stem 4, the metal flange portion 15*b* of the stem 4 and the metal flange portion 16*b* of the side tube 20 are brought into close contact with each other and, with this state being maintained,, thus joined part is subjected to a welding operation such as electric welding, laser welding, or the like, so as to effect hermetic sealing of the sealed envelope 2. After this welding operation, the air in the sealed envelope 2 is evacuated through the exhaust pipe 13, the sealed envelope 2 is subsequently filled with about several Torr of deuterium gas, and the exhaust pipe 13 is closed thereafter, whereby the assembling operation is completed. Here, the first flange portion 15*b* is utilized as a reference position with respect to the light-emitting part of the gas discharge tube 1 (the part where arc balls are generated in front of the focusing opening 8*a*). Namely, when the positional relationship between the first flange portion 15*b* and the light-emitting part is kept constant upon assembling the discharge tube 1, the positioning of the light-emitting part becomes easier, whereby the assembling workability and positioning accuracy with respect to an apparatus for driving the gas discharge tube 1 (not depicted) are expected to improve.

Figure 2:
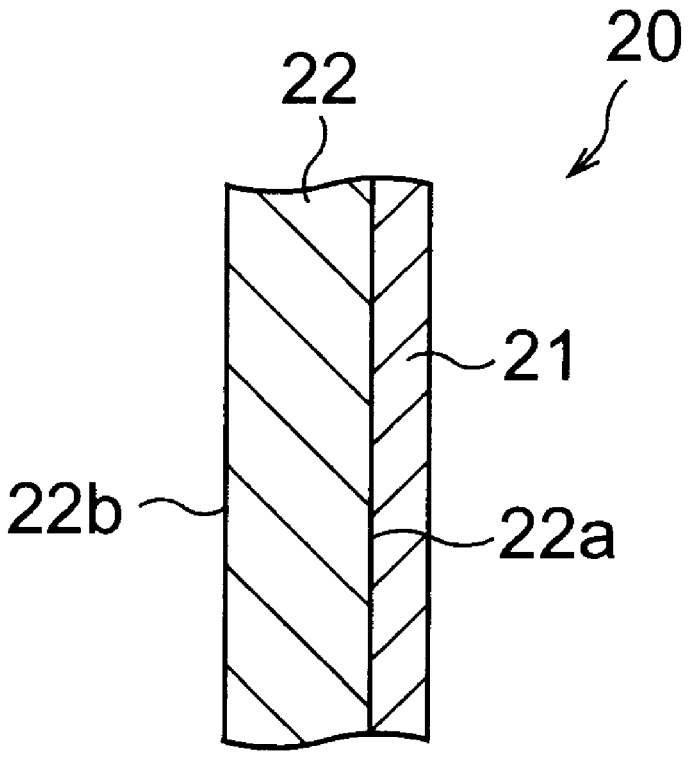
FIG. 2 is an enlarged view of the wall portion of its side tube.

Further, the inner wall face 22A of the side tube body 22 of the side tube 20 is coated with a Kovar glass material 21 substantially over the whole surface thereof as shown in FIG. 2. For making such a side tube 20, the side tube body 22 made of a metal is initially molded into a predetermined form by pressing. Thereafter, for inhibiting the gas filling the sealed envelope 2 from inconveniently being transmitted through or occluded in the side tube body 22, i.e., for avoiding various inconveniences which may occur depending on the combination of the material of the side tube body 22 itself and the gas filling the sealed envelope 2, the inner wall face 22*a* of the side tube body 22 is coated with the glass material 21 by painting or CVD. As a result, not only the life of the gas discharge tube 1 can be kept from shortening, but also the side tube body 22 is encouraged to have a wider range of processed forms and securely attains a prospect for mass production since it is made of a material which is easier to mold by pressing.

As the glass material 21, silica type glass and crystallized glass can also be employed. Since the crystallized glass is glass in which crystals are deposited, it can securely inhibit a phenomenon such as transmission, occlusion, or chemical reaction which may occur in the side tube body 22. Examples of the crystallized glass include $MgF_2$ glass, sapphire glass, $SiO_2$ glass, $CaF_2$ glass, and the like.

In the case where impurities contained in the glass material 21 are let out into the sealed envelope 2 during the assembling or use of the gas discharge tube 1 and thereby adversely affect characteristics of the gas discharge tube 1, the glass material 21 may be disposed on the outer wall face 22*b* of the side tube body 22. Also, the glass material 21 may be disposed on both of the inner wall face 22*a* and outer wall face 22*b* as a matter of course.

Operations of thus configured gas discharge tube 1 will now be explained in brief. First, an electric power of about 10 W is supplied from an external power source to the cathode section 9 for about 20 seconds, so as to preheat the cathode section 9. Thereafter, a DC release voltage of about 150 V is applied across the cathode section 9 and the anode plate 6, so as to prepare for arc discharge.

In the state where the preparation is in order, a trigger voltage of about 350 V to 500 V is applied across the cathode section 9 and the anode plate 6. Here, while being rectified by the discharge rectifying plate 11, the thermions released from the cathode section 9 converge at the focusing opening 8*a* of the focusing electrode plate 8 and reach the anode plate 6. Then, arc discharge occurs in front of the focusing opening 8*a,* and ultraviolet rays taken out from the arc balls generated upon this arc discharge are transmitted through the light projection window 19 and released outside, i.e., in the direction of arrow A.

The present invention is not restricted to the embodiment mentioned above. For example, an object similar to that with the above-mentioned glass material 21 can be achieved when one or both of the inner wall face 22*a* and outer wall face 22*b* of the side tube body 22 are coated with ceramics (alumina, silicon nitride, or the like) in place of the glass material 21. Also, the side tube body 22 may be made of a material which is a nonmetal, e.g., ceramics. Examples of the gas filling the sealed envelope 2 include not only deuterium gas but also mercury vapor, helium gas, neon gas, and the like. These gases are those not preferably combined with the metal-made side tube body in terms of the life and reliability of the product. The present invention is also applicable to side-on type discharge tubes as a matter of course.

Since the gas discharge tube in accordance with the present invention is configured as mentioned above, it can reduce dimensions of the gas discharge tube itself and attain a freedom in processing at the same time.

The present invention is suitably applicable to a gas discharge tube, such as a gas discharge tube for use as a light source for a spectroscope, chromatography, or the like in particular; and is employable as a deuterium lamp, mercury lamp, helium gas lamp, neon gas lamp, and the like, for example.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A gas discharge tube having a sealed envelope at least a part of which transmits light, said sealed envelope being filled with a gas and being provided with anode and cathode sections disposed therein, electric discharge being generated between said anode and cathode sections, so that the light-transmitting part of said sealed envelope emits predetermined light outside;

said sealed enveloped comprising:

a stem for securing said anode and cathode sections by way of respective stem pins independent from each other;

a side tube surrounding said anode and cathode sections and being secured to said stem; and a light projection window secured to said side tube and formed from a material transmitting light, wherein substantially the entire interior surface of said side tube is coated with a glass material or ceramics.

2. A gas discharge tube according to claim 1, wherein the coating of the wall face of said side tube is crystallized glass.

* * * * *